US005906065A

United States Patent [19]

Pearce

[11] Patent Number: 5,906,065

[45] Date of Patent: May 25, 1999

[54] FLOOR PLATE FOR HANDGUN MAGAZINE

[75] Inventor: R. Lane Pearce, Bothell, Wash.

[73] Assignee: Pearce Grip, Inc., Bothell, Wash.

[21] Appl. No.: 08/920,136

[22] Filed: Aug. 27, 1997

[51] Int. Cl.[6] ..... F41A 9/61

[52] U.S. Cl. ..... 42/50; 42/7

[58] Field of Search ..... 42/50, 7

[56] References Cited

U.S. PATENT DOCUMENTS

| | | | |
|---|---|---|---|
| D. 344,780 | 3/1994 | Jenkins | D22/108 |
| D. 362,044 | 9/1995 | Sniezak | D22/108 |
| 2,620,582 | 12/1952 | Stukas | 42/50 |
| 2,927,390 | 3/1960 | Lewis | 42/65 |
| 3,758,978 | 9/1973 | Theodore | 42/71.02 |
| 4,107,863 | 8/1978 | Musgrave | 42/50 |
| 4,343,107 | 8/1982 | Kaltenegger | 42/7 |
| 4,397,109 | 8/1983 | Pachmayr et al. | 42/50 |
| 4,413,437 | 11/1983 | Anderson | 42/50 |
| 4,495,720 | 1/1985 | Bross | 42/7 |
| 4,514,922 | 5/1985 | Farrar et al. | 42/50 |
| 4,520,585 | 6/1985 | Barrett | 42/7 |
| 4,539,889 | 9/1985 | Glock | 89/147 |
| 4,586,281 | 5/1986 | Chesnut | 42/50 |
| 4,592,160 | 6/1986 | Bross | 42/7 |
| 4,765,081 | 8/1988 | Dieringer | 42/50 |
| 4,825,744 | 5/1989 | Glock | 89/145 |
| 4,862,619 | 9/1989 | Baldus et al. | 42/7 |
| 4,893,546 | 1/1990 | Glock | 89/145 |
| 4,995,179 | 2/1991 | Switzer | 42/50 |
| 5,052,140 | 10/1991 | Smith | 42/7 |
| 5,438,783 | 8/1995 | Sniezak et al. | 42/7 |
| 5,461,811 | 10/1995 | Ciener | 42/50 |
| 5,526,600 | 6/1996 | Chesnut et al. | 42/50 |
| 5,557,872 | 9/1996 | Langner | 42/103 |
| 5,584,136 | 12/1996 | Boland | 42/7 |
| 5,642,582 | 7/1997 | Grams | 42/50 |
| 5,651,204 | 7/1997 | Hulsey et al. | 42/50 |

*Primary Examiner*—Charles T. Jordan
*Assistant Examiner*—Meena Chelliah
*Attorney, Agent, or Firm*—Dowrey & Associates

[57] ABSTRACT

A handgun cartridge magazine floor plate for a handgun grip frame having a circular cut-out area in the front wall thereof. The floor plate has a flat body which attaches to the bottom end of a tube-type magazine and an extended front end section with a dome-like upwardly directed projection which fills the cut-out area when the magazine is in place in the grip frame. The projection blocks the cut-out area, extends the available gripping surface and enhances manual removal of the magazine.

12 Claims, 2 Drawing Sheets

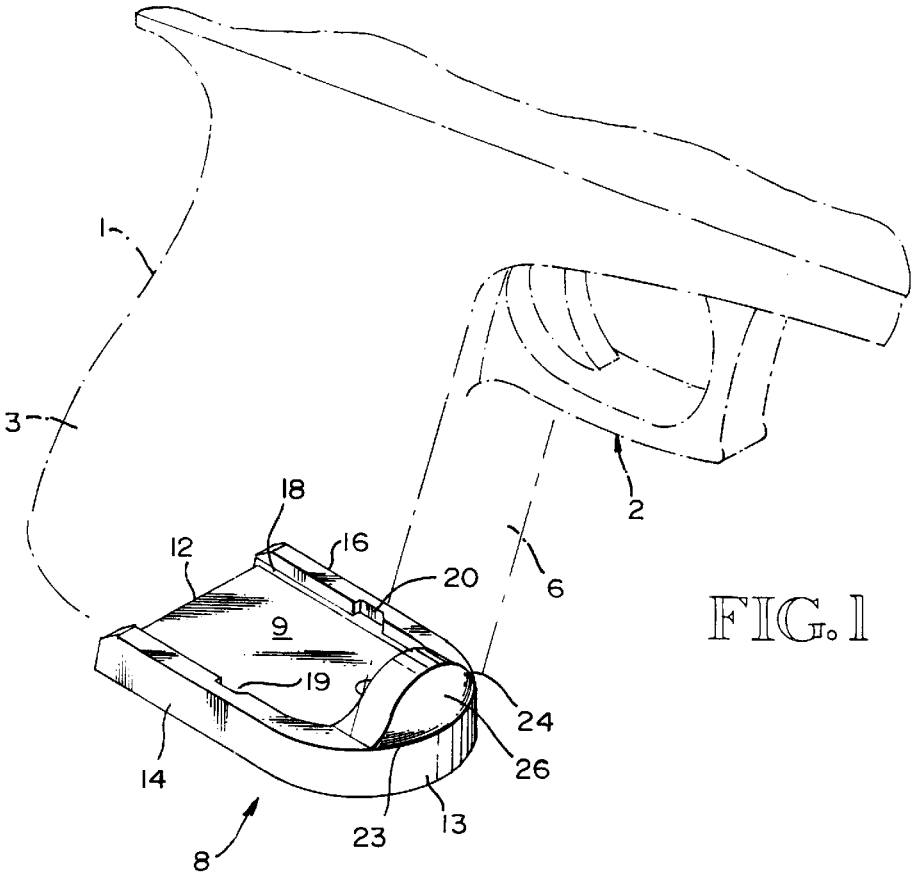
FIG. 1
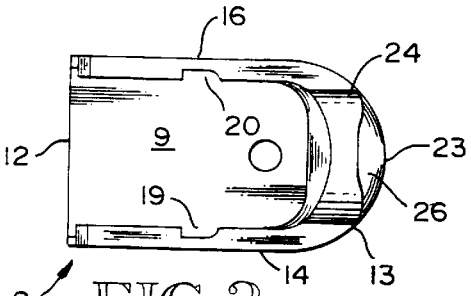
FIG. 2
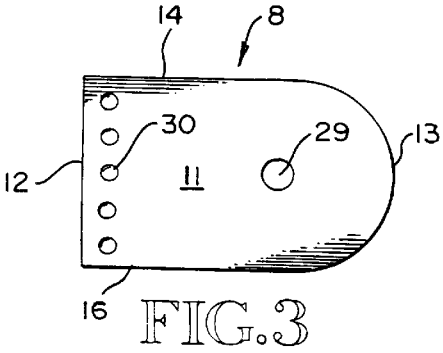
FIG. 3
FIG. 4
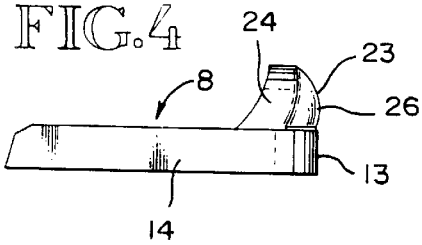
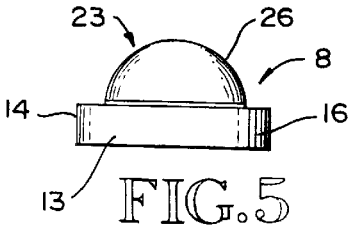
FIG. 5
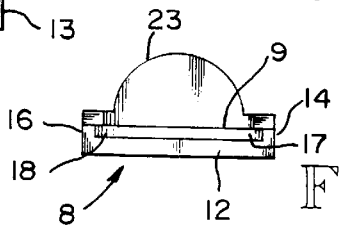
FIG. 6

FLOOR PLATE FOR HANDGUN MAGAZINE

BACKGROUND OF THE INVENTION

1. Field of the Invention

The present invention relates to a floor plate assembly for a well known tube-type cartridge magazine commonly used in semi-automatic firearms or handguns. The floor plate assembly of the present invention acts as a base or closure element for the magazine and is rigidly attached thereto to provide a base for the usual thrust transmission plate of the magazine spring. More particularly, the invention relates to the particular configuration of a floor plate assembly which enables a cooperation between the magazine base and a particular handgun grip configuration.

2. Description of the Prior Art

The use of magazine base plates or butt plates as grip enhancers for the handle of various handgun grip designs is well known in the art. U.S. Pat. No. 4,343,107 to Kaltenegger for instance utilizes an extended sleeve about the magazine base in combination with a base plate to enlarge the grip area of the gun handle while providing increased cartridge capacity. U.S. Pat. No. 5,557,872 to Langner is another example wherein the magazine base plate assembly is used to house a power supply for a laser sighting device. The magazine base plate of Langner also cooperates with the gun handle to increase the grip area. U.S. Pat. No. 5,438,783 to Sniezak et al discloses a magazine butt plate or floor plate which extends below the bottom end of the front and a portion of the side walls of the gun handle in order to enhance the gripping surface as well as to accommodate different length magazine tubes. As is common with this type of construction, the magazine floor plate is located completely below and extends beyond the bottom walls of the forward finger grip area of the gun handle.

As shown in the Stukas U.S. Pat. No. 2,620,582 and the Musgrave U.S. Pat. No. 4,107,863, other base plate configurations have been utilized to provide a forwardly extending projection which may be used to aid in the withdrawal of the magazine from the magazine well. Although the majority of magazine floor plate designs locate the floor plate completely below the bottom perimeter of the gun handle to thus extend the finger grip area, it is well known to provide an upwardly extending shoulder or indexing tab which engages a recess in the bottom edge of the front wall of the gun handle. The conventional practice, however, is to fair the surface of the base plate smoothly into the front contour of the gun handle. Examples of this construction are noted in the Boland et al U.S. Pat. No. 5,584,136 and Baldus et al U.S. Pat. No. 4,862,619.

Certain recent semi-automatic handgun designs incorporate a magazine well for receiving magazines with relatively flat and reduced thickness floor plates which only partially cover the grip base and do not add appreciably to the grip length. Examples of this configuration are shown in the Glock U.S. Pat. Nos. 4,539,889; 4,825,744 and 4,893,546. This design is also present in recent Glock handgun models 17–24. The practice is to provide the front wall of the grip handle with a semi-circular cut-out leaving a void directly above the magazine floor plate. The purpose of the cut-out is to allow the user to eject the magazine by finger pressure in the event of jamming or malfunction of the magazine release mechanism. This particular design has certain drawbacks in the nature of discomfort due to the rough and uneven surfaces presented to the little finger of the gripping hand. The effect of the rough and uneven surfaces is to actually reduce the grip length since the third finger becomes relatively ineffective. The semi-circular cut-out portion of the front wall of the handgrip has rather sharp edges because of the usual flared bottom end of the grip handle which can actually hamper rapid manual ejection of the empty magazine. Needless to say, the provision of a cut-out section in the front wall of the gripping surface also greatly increases the possibility of entry of unwanted debris into the magazine well.

The aesthetic appeal of the overall gun handle is severely diminished by the cut-out section of the grip area as well as the foreshortened magazine floor plate which leave the impression of an unfinished product. It is well appreciated in the handgun art that pleasing contours and ornamental enhancement are valuable assets. The aesthetic appeal of a well dressed overall appearance enhances marketability and is sought after by handgun connoisseurs. Also, professionals who depend on handgun protection appreciate good craftsmanship and a "finished" appearance.

SUMMARY OF THE INVENTION

The magazine floor plate of the present invention connects to the bottom end of well known tube type handgun magazines and is held in place on the tube bottom by means of a snap lock arrangement which cannot be released without the use of a tool. The floor plate is designed to seat and act as a base for the usual pressure transmission plate of the magazine spring. The floor plate may also be provided with means for the reception of a detente on the pressure transmission plate.

The novel floor plate is configurated for special cooperation with a cut-out area extending upwardly from the bottom edge of the front wall of the grip. The cut-out area normally provides access for applying finger pressure to the floor plate to manually extract the magazine. The front end section of the floor plate preferably extends forwardly to at least the approximate position of the bottom edge of the front wall of the handgrip and is provided with an upwardly extending projection the top surface of which conforms to the approximate configuration of the cut-out area and fairs into the handgrip wall. The upwardly extending projection and the forward or leading face thereof may be configured to provide aesthetic appeal in cooperation with the overall contours of the plate and at the same time to present a comfortable finger rest for the third finger of the gripping hand. The floor plate thus provides extra gripping surface without increasing the overall length of the grip. Because the upwardly extending projection on the front end of the floor plate extends forwardly of the contours of the front wall of the grip, manual extraction of the magazine is greatly facilitated and improved over prior art configurations. The floor plate also provides a closure for the opening left by the cut-out area in the wall of the magazine well thus eliminating the possibility of entry of unwanted debris into the well. The bottom face of the floor plate may include a plurality of discrete surface irregularities such as depressions or protrusions which may be coded, as by color for instance, to enable identification and "tracking" of a particular magazine. Such coding may also take other forms such as alphanumeric coding or other indicia carried by the floor plate. In situations where multiple magazines are in constant use, maintenance and repair considerations require such identification and tracking.

The configuration of the floor plate of the present invention also functions to provide aesthetic appeal to the overall gun handle appearance because of its pleasing contours and ornamental enhancement. The present floor plate renders a well dressed or "finished" appearance to the otherwise rough features of the cut-out area and foreshortened magazine floor plate of the prior art.

BRIEF DESCRIPTION OF THE DRAWINGS

FIG. 1 is a perspective view of the floor plate with the grip portion of the handgun shown in phantom lines;

FIG. 2 is a top plan view of the floor plate;

FIG. 3 is a bottom plan view of the floor plate;

FIG. 4 is a side elevational view of the floor plate;

FIG. 5 is a front elevational view of the floor plate;

FIG. 6 is rear elevational view of the floor plate;

DESCRIPTION OF THE PREFERRED EMBODIMENT

Figure 7:
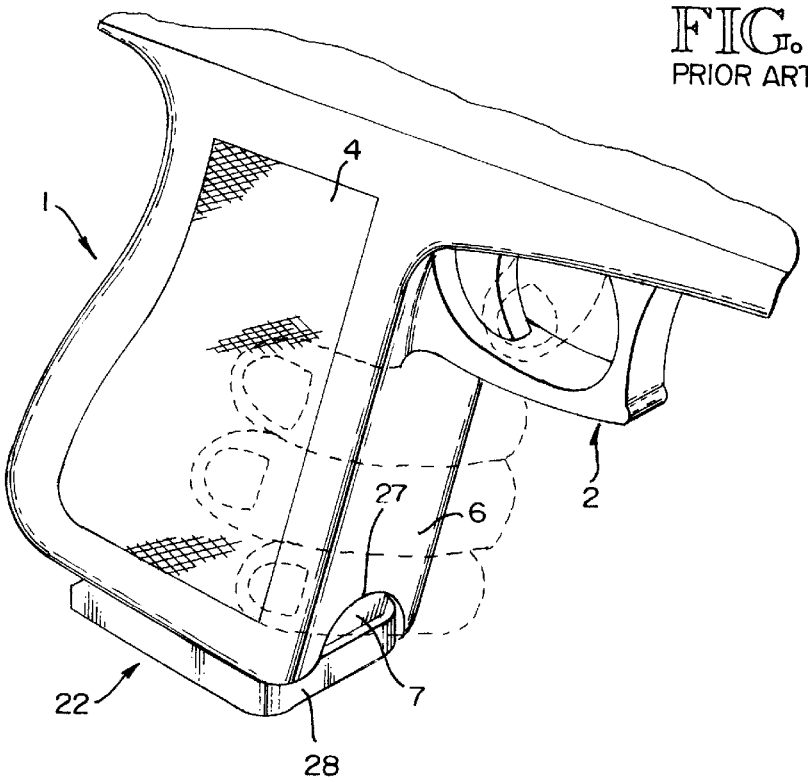
FIG. 7 PRIOR ART
FIG. 7 is a perspective view of a prior art magazine and floor plate installed in the magazine well of a handgun of the type under consideration with the position of the gripping fingers shown in phantom lines.
Figure 8:
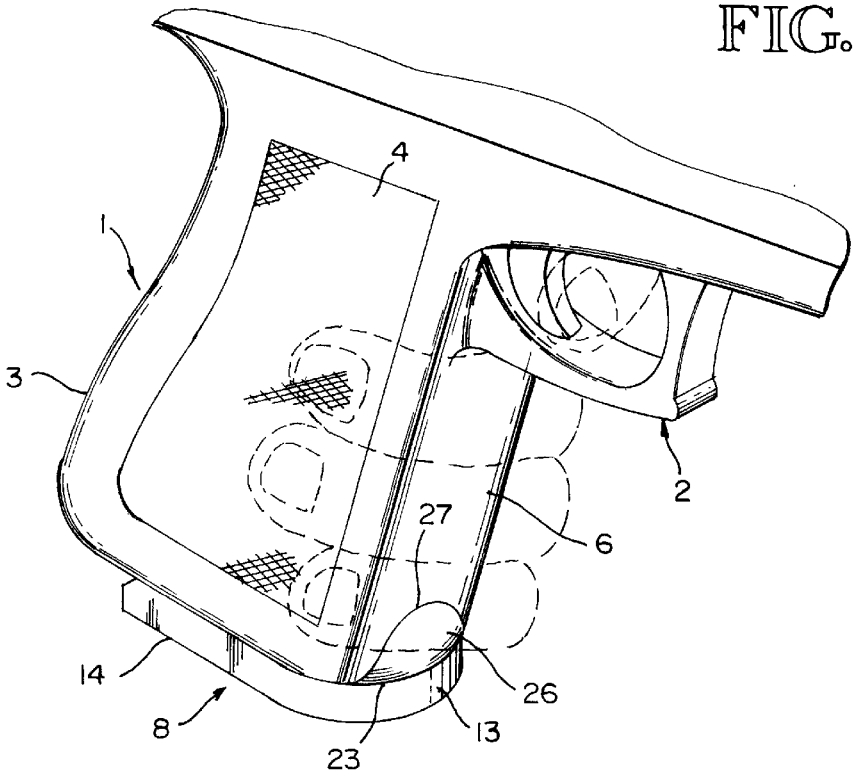
FIG. 8 is a perspective view of a magazine and floor plate of the present invention in position in the magazine well of a handgun of the type under consideration with the position of the gripping fingers shown in phantom lines.

Handgrips for handguns of the general type under consideration are shown in FIGS. 7 and 8 and in the dotted line portions of FIG. 1. It will be understood that the configuration of the handgrip 1 is well known in the art and is subject to many design variations. Only those features necessary for describing the structure of the floor plate of the present invention are illustrated. The handgrip includes the trigger section 2 and side walls 3 which may take any one of many known designs, usually including the checkered or otherwise roughened surfaces 4 for better gripping characteristics. The side walls are joined by a rear wall (not shown) and a front wall 6 which may be rounded or otherwise shaped to present a gripping surface for three fingers of the user's hand. The front and rear walls may also include roughened surfaces to enhance the gripping characteristics. In recent years, the trend has Leen toward manufacturing-economy and weight reduction with the entire handgrip section of the gun handle, as well as the barrel base and trigger housing, being formed as a single injection molded piece. The handgrip 1 is generally hollow and provides a well for the reception and retention of a cartridge magazine such as the magazine 7 shown in FIG. 7. The details of construction of the magazine 7 and its releasable positioning in the magazine well is known in the art and forms no part of the present invention. Reference may be directed to U.S. Pat. Nos. 4,539,889, 4,825,744 and 4,893,546 for details of typical magazine positioning and release mechanisms. As will be evident from the illustrations in FIGS. 7 and 8, the trend has been toward limiting the length of the grip section 1 and restricting its length to that sufficient for positioning three fingers of the user's hand. The need for any additional length in the handgrip has been alleviated because of the legal limit placed on magazine capacity and the demand for firearms of reduced size and weight.

Referring to FIGS. 1–6, the floor plate may be formed as a single injection molded piece and may be made from a high impact non-metallic plastic material. Other materials and methods of manufacture are, of course, within the scope of the present invention. In the present embodiment, the plate comprises a flat body 8 having a generally planar top surface 9 and a planar bottom surface 11. The body 8 is generally rectangular in plan with a straight back wall 12 and a curved front wall 13. The right and left hand side walls 14 and 16, as viewed in FIG. 2, are straight and extend between the curved front wall 13 and the back wall 12. As seen most clearly in FIGS. 1 and 6, the side walls 14 and 16 as well as the front wall 13 extend above the level of the top surface 9 of the plate. The side walls 14 and 16 are provided with narrow longitudinal grooves 17 and 18 respectively designed to receive mating side flanges on the tubular magazine in a manner well understood by those familiar with the art. The mating flanges on the magazine base are provided with lugs which engage the notches 19 and 20 in the side walls of the floor plate with a tight snap lock fit which retains the floor plate on the bottom of the tubular magazine once the magazine flanges are slid into the notches 17 and 18. As seen most clearly in FIG. 2, once engaged, the right angular rear walls of the notches 19 and 20 prevent the floor plate from being removed from the magazine. It will be understood that the prior art floor plate 22 shown in FIG. 7 is engaged with the bottom end of the tubular magazine 7 in the manner just described as is conventional in the art.

The curved front end section of the plate is provided with an upstanding semi-circular dome-like projection 23 having its base width approximately equal to the thickness of the wall 13 and its top width of somewhat reduced dimensions as defined by the curved surface 24. This configuration results in a convexly curved leading surface 26 extending from the upper crest of the surface 24 to the curved front wall surface 13 as seen in elevation in FIG. 4.

As shown most clearly in FIGS. 7 and 8, the front wall 6 of the handgrip has a cut-out area defined by the upwardly curved wall section 27 which extends from a position adjacent the bottom edge of the rounded corner of the front wall at one side, curves upwardly and terminates adjacent the bottom edge of the opposite rounded corner of the front wall. As aforementioned, the purpose of the cut-out area defined by the edge 27 is to enable finger pressure to be applied to the floor plate 22 of the prior art magazine 7 in case of jamming or binding. As seen in FIG. 7, the outside edge of the wall section 27 protrudes slightly because of the curvature of the front wall 6 and the usual flare at the bottom of the grip 1. The combination of the curved edge and the rounded or flared contour of the grip results in a somewhat prominent surface along the curved edge of section 27 which must be contacted by the finger of the user's hand as clearly shown in FIG. 7. It will be noted also that the forward edge 28 of the prior art floor plate 22 is located somewhat to the rear of the front wall 6 and curved edge 27 which fails to offer any relief to the discomfort of the finger contact.

As shown in FIG. 8, with the floor plate 8 of the present invention and the magazine in position in the magazine well, the forward curved end section and wall 13 of the plate extends to the approximate position of the wall 6 and can extend even beyond this point. This places the dome-like projection 23 within the cut-out area with the curved configuration of the dome in approximate conformance with the curved outline of the edge 27. It will be understood, of course, that the particular curvature or other outline of the edge 27 and the projection surface may be varied without departing from the invention. Further, the convexly curved leading surface 26 of the projection extends forwardly and downwardly in a curved contour to the front wall 13 of the floor plate. As will be evident from FIG. 8, filling the void left by the cut-out portion of the front wall of the grip provides a smooth surface for contact by the little finger of the gripping hand. The result is not only a better feel when holding the firearm but a stronger grip on the gun handle is made possible. This effect is obtained without increasing the overall length of the grip. Additionally, with the cut-out area of the front wall of the handgun grip blocked, debris can no longer enter the magazine well to interfere with the operation of the magazine tube. The original function of the cut-out area in the front wall of the grip is maintained and in fact enhanced since the protruding convex wall 26 of the dome-like projection offers additional finger pressure surface for manually removing the magazine.

As seen in FIGS. 2 and 3, the plate body 8 is provided with a through bore or hole 29 which is positioned to receive a detente on the magazine pressure transfer plate. The transfer plate is thus positively positioned within the magazine when the floor plate is applied. As seen in FIG. 3, a plurality of discrete surface irregularities 30 is provided which, in the preferred embodiment, constitute circular surface depressions. The floor plate may thus receive an identification code by coloring one or more of the depressions 30 to identify the particular magazine for tracking purposes. It will be understood, of course, that other expedients such as different shaped depressions or even various shapes of discrete protrusions could be utilized to accomplish this purpose. In the alternative digital coding such as numeric, alphabetical or alphanumeric surface indicia may be utilized.

It is to be understood that the foregoing description and accompanying drawings have been given by way of illustration and example. It is also to be understood that changes in form of the several parts, substitution of equivalent elements and materials and arrangement of parts which will be readily apparent to one skilled in the art, are contemplated as being within the scope of the present invention which is limited only by the claims which follow.

What is claimed is:

1. A magazine floor plate for a cartridge magazine adapted to be received in a hollow handgrip frame of a handgun, said frame having a front wall with a cut-out area in the bottom edge thereof comprising;

a floor plate body including an upwardly directed projection extending into said cut-out area, and a forwardly directed protrusion on said projection extending beyond said front wall, whereby said cut-out area is blocked, the handgrip area is increased and said projection enhances manual removal of the magazine.

2. For use with a handgun having a hollow hand grip frame for receiving and positioning a cartridge magazine, said hand grip frame having a front wall with a cut-out area in the bottom edge thereof, a magazine floor plate comprising;

a floor plate body including side walls and a front end section extending to the approximate position of said front wall when said magazine is positioned in said frame, and an upwardly directed projection on said front end section extending above said side walls and into said cut-out area in the hand grip frame, said projection including a leading surface extending forwardly of said front wall.

3. In a tube-type cartridge magazine for handguns of the type having a hollow handgrip frame for receiving and positioning said magazine, said frame including a front wall with a finger grip surface thereon and a cut-out area on the bottom edge thereof extending above the bottom peripheral edge of said frame, a magazine floor plate comprising;

a substantially flat floor body attached to the bottom end of said magazine adapted for positioning adjacent the bottom peripheral edge of said frame when the magazine is positioned therein, said floor body including a front end section extending to the approximate position of said finger grip wall surface, and an upwardly directed projection on said front end section extending into said cut-out area, said projection having a top wall surface substantially conforming to and fairing into said front wall surface, said projection including a leading convex curved surface extending forwardly of the finger grip surface and terminating in the front end section of the floor plate body, whereby said cut-out area is blocked, the finger grip surface is increased and said projection enhances manual removal of said magazine.

4. The device of claim 3 wherein;

said front end section extends forwardly beyond said finger grip surface, and said cut-out area and the top wall of said projection are semi-circular.

5. The device of claim 4 wherein;

the bottom edge of said frame is flared outwardly in the area of said finger grip surface, said projection is dome-shaped and said leading surface is a convexly curved surface faired into the flared edge of said frame.

6. The device of claim 3 wherein said floor body has a top and bottom surface, and a plurality of discrete surface irregularities on said bottom surface, whereby said surface irregularities may be coded to promote identification indicia for tracking said magazine.

7. The device of claim 6 wherein said surface irregularities comprise a series of circular depressions in the body surface adapted for color coding.

8. In a cartridge magazine having an upper end for feeding cartridges and a bottom end adapted to receive a closure type floor plate, a floor plate assembly comprising;

a plate body having an exposed surface, attaching structure carried by said magazine and said plate body for attaching the floor plate assembly to the bottom end of the magazine, a coding area on said exposed surface, and coding indicia carried by said coding area for unique identification of said magazine.

9. The apparatus of claim 8 wherein said coding indicia includes discrete spaced surface irregularities in the exposed surface of the coding area.

10. The apparatus of claim 9 wherein said surface irregularities include a plurality of spaced depressions in said exposed surface.

11. The apparatus of claim 9 wherein said surface irregularities include a plurality of surface protrusions in said exposed surface.

12. The apparatus of claim 8 wherein said coding indicia includes discrete digital markings on the exposed surface of the coding area.

* * * * *